US007233478B2

(12) United States Patent
Lum

(10) Patent No.: US 7,233,478 B2
(45) Date of Patent: Jun. 19, 2007

(54) METHOD AND APPARATUS FOR PROTECTING A SOLENOID AND ITS DRIVING CIRCUIT IN AN ELECTRONIC DEVICE

(75) Inventor: Jackson Lum, Roslyn, NY (US)

(73) Assignee: Logic Controls, Inc., New Hyde Park, NY (US)

( * ) Notice: Subject to any disclaimer, the term of this patent is extended or adjusted under 35 U.S.C. 154(b) by 315 days.

(21) Appl. No.: 10/886,512

(22) Filed: Jul. 7, 2004

(65) Prior Publication Data

US 2005/0083629 A1 Apr. 21, 2005

Related U.S. Application Data

(60) Provisional application No. 60/486,522, filed on Jul. 11, 2003.

(51) Int. Cl.
*H01H 47/00* (2006.01)

(52) U.S. Cl. ..... 361/152

(58) Field of Classification Search ..... 361/157, 361/152

See application file for complete search history.

(56) References Cited

U.S. PATENT DOCUMENTS 3,061,185 A * 10/1962 Richard ..... 235/22
3,412,395 A * 11/1968 Kiene, Jr. ..... 340/654
3,456,164 A * 7/1969 Sternberg ..... 361/155
3,500,416 A * 3/1970 Ellsworth ..... 327/475
5,111,394 A 5/1992 Hilles et al.

* cited by examiner

*Primary Examiner*—Ronald W. Leja
(74) *Attorney, Agent, or Firm*—Hoffmann & Baron, LLP

(57) ABSTRACT

A circuit for protecting a solenoid and/or receipt printer in an electronic device, such as a point-of-sale terminal, includes a resistance and a capacitance. The resistance is electrically coupled in parallel with the capacitance, and the parallel network of resistance and capacitance is coupled in series with the solenoid. An energizing signal is applied to the parallel network to energize the solenoid. A method of protecting a solenoid and/or receipt printer in the electronic device includes the steps of coupling a resistance electrically in parallel with a capacitance, coupling the parallel network electrically in series with the solenoid, and applying an energizing signal to the parallel network to energize the solenoid. The capacitance preferably includes two polarized electrolytic capacitors electrically coupled in a back-to-back series configuration with common polarities connected to each other.

29 Claims, 6 Drawing Sheets

METHOD AND APPARATUS FOR PROTECTING A SOLENOID AND ITS DRIVING CIRCUIT IN AN ELECTRONIC DEVICE

CROSS REFERENCE TO RELATED APPLICATION

This application claims the benefit of U.S. Provisional Application No. 60/486,522 filed on Jul. 11, 2003, the disclosure of which is incorporated herein by reference.

BACKGROUND OF THE INVENTION

1. Field of the Invention

The present invention generally relates to a method and apparatus for protecting a solenoid and its associated driving circuit in an electronic device and more particularly to protecting a solenoid and the associated driving circuit in a point-of-sale terminal having a solenoid operated cash drawer driven by a circuit in a receipt printer.

2. Description of the Related Art

The use of software to control the operation of electronic business machines, such as point-of-sale (POS) terminals has become widespread. For example, software in these machines is typically used to generate a signal that energizes a solenoid to open a cash drawer.

A fault or malfunction in the software or intervening hardware may cause the signal to continue indefinitely, thereby causing the solenoid to remain energized. If the solenoid is energized for a period that exceeds its rated duty cycle, the driving circuit and the solenoid will likely be damaged. The user will then be required to spend a considerable amount of time and money to repair the cash drawer and/or receipt printer before the POS terminal is able to function properly again.

A partial block diagram of a conventional POS system 10 is shown in FIG. 1. Under normal operating conditions, application software residing in a computer 12 controls, among other functions, the opening of a cash drawer 14. Specifically, to open the cash drawer 14, a popular command issued by the computer 12 to a receipt printer 16 is the character CTRL-G, which is not a printable character.

The receipt printer 16 interprets CTRL-G as a command to output a pulse that opens the cash drawer 14. Typical parameters of the pulse include a duration T of 100–500 milliseconds and a peak voltage Vcc of 12–24 VDC, which is often applied to the base of a transistor 18 in the receipt printer 16 used to drive an energizing signal 20 between Nodes D1 and D2.

The cash drawer solenoid 22 typically has a relatively high Q or quality factor, which is the ratio of its reactance to it effective series resistance at a given frequency. Specifically, the inductance of the solenoid 22 is high but the resistance is low. Thus, for relatively short pulse durations, such as the preferred 100–500 millisecond energizing signal 20, the impedance of the solenoid 22 is high, which limits the current through the transistor 18 and solenoid 22 to an acceptable value. However, for pulses having a longer duration, the impedance of the solenoid becomes very low, which may appear as a short circuit to the driving transistor 18 in the receipt printer 16.

Burnout of the transistor 18 and/or the solenoid 22 occurs whenever the duration of the pulse exceeds a certain value. Burnout also occurs if the output of the transistor 18 is momentarily grounded, which may happen during system installation.

U.S. Pat. No. 5,111,394 to Hilles et al. (Hilles), which is incorporated herein by reference, describes an electronic business machine having a cash drawer and a timeout circuit. The timeout circuit couples the output of a microprocessor to a driver for a programmable period of time. The driver provides a signal that energizes a solenoid to open the cash drawer. In an alternative embodiment, a multivibrator is substituted for the timeout circuit.

Hilles overcomes the problem of damaged transistors and solenoids common in conventional POS systems by limiting the period of time that the solenoid is energized. However, in the first embodiment of Hilles, the timeout circuit requires over thirty digital devices that add to the cost and require a significant amount of board space, as well as a source of power. Although the second embodiment of Hilles implements the timeout function in a single integrated device, that is, a multivibrator, such an active device still represents an unreliable and significant additional cost while requiring its own source of power. These characteristics substantially limit the location of and applications for the solutions proposed in Hilles.

It is an objective of the present invention to provide a much simpler and more reliable method and apparatus for protecting a solenoid and/or receipt printer in an electronic device, such as a point-of-sale terminal, which uses inexpensive passive components that do not require a source of power.

It is another objective of the present invention to provide a method and apparatus for protecting a solenoid and/or receipt printer in an electronic device, such as a point-of-sale terminal, that requires only a small amount of space and consumes negligible power.

It is yet another objective of the present invention to provide a method and apparatus for protecting a solenoid and/or receipt printer in an electronic device, such as a point-of-sale terminal, which can be used to retrofit existing electronic devices, as well as being designed into new equipment.

It is still another objective of the present invention to provide a method and apparatus for protecting a solenoid and/or receipt printer in an electronic device, such as a point-of-sale terminal, that employs a simple, straightforward design that is reliable, easy to test, and relatively maintenance free.

SUMMARY OF THE INVENTION

These and other goals, purposes, and objectives are met by the present invention, which provides an apparatus for protecting a solenoid and/or receipt printer in an electronic device. The apparatus includes a resistance and a capacitance. The resistance is electrically coupled in parallel with the capacitance and the parallel network of resistance and capacitance is coupled in series with the solenoid.

An energizing signal is applied to the parallel network to energize the solenoid. The capacitance preferably includes two polarized electrolytic capacitors electrically coupled in a back-to-back series configuration having common polarities of the capacitors connected to each other.

The present invention also provides a method for protecting a solenoid and/or receipt printer in an electronic device. The method includes the steps of coupling a resistance electrically in parallel with a capacitance, coupling the parallel network of resistance and capacitance in series with the solenoid, and applying an energizing signal to the parallel network to energize the solenoid. The capacitance preferably includes two polarized electrolytic capacitors electrically coupled in a back-to-back series configuration with common polarities connected to each other.

These and other objectives, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
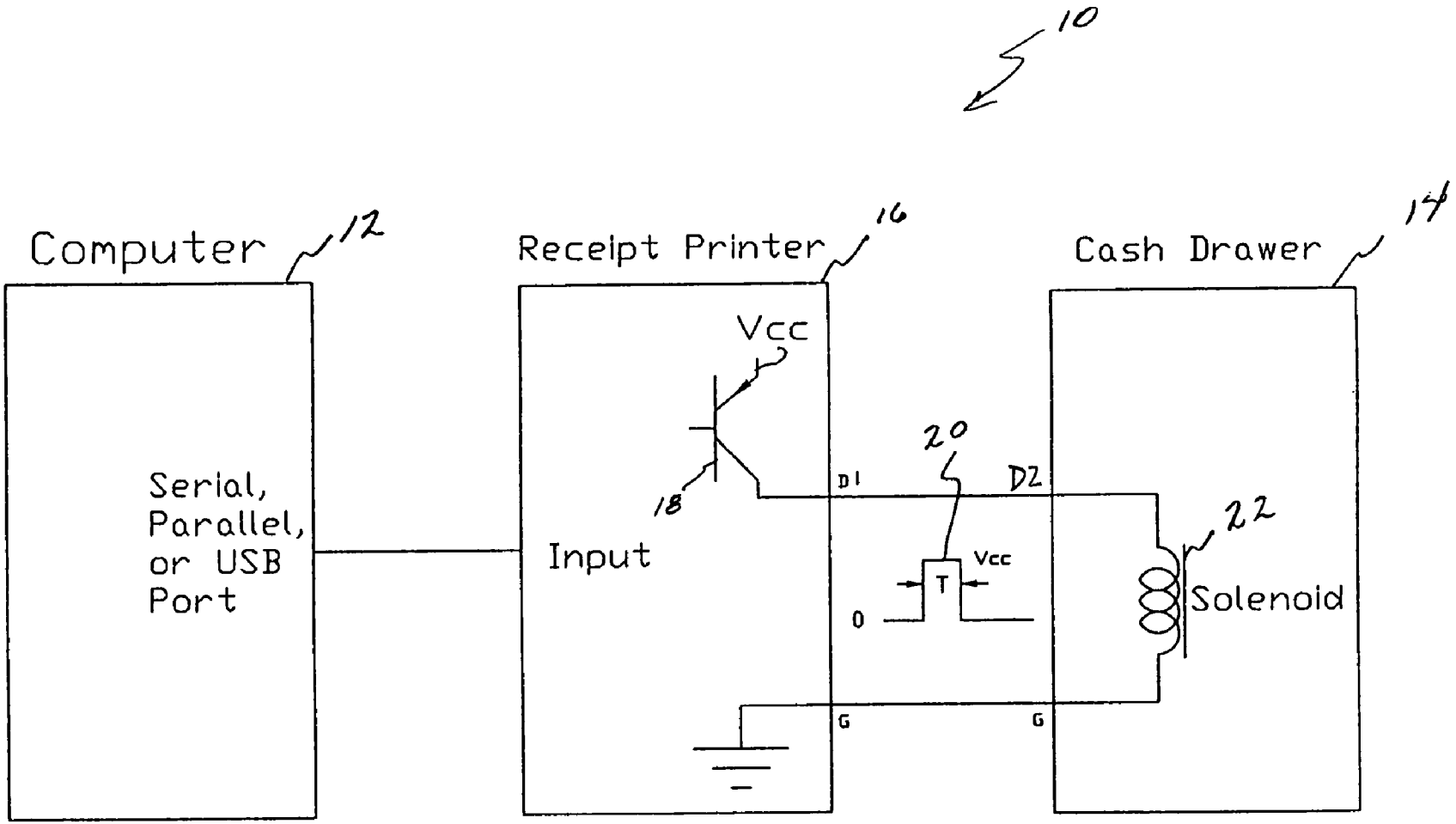
Figure 1 PRIOR ART
FIG. 1 is a block diagram of a conventional point-of-sale (POS) system.
Figure 2:
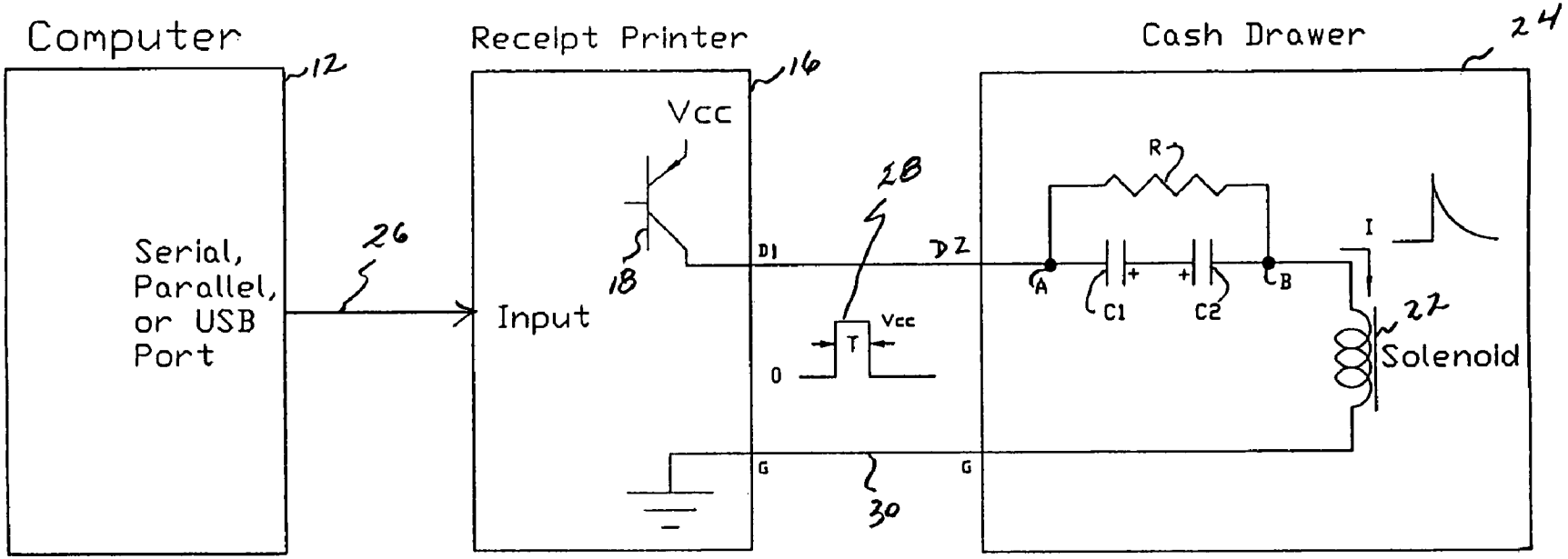
FIG. 2 is a block diagram of a first embodiment of a point-of-sale (POS) system formed in accordance with the present invention.

FIG. 2 shows a first embodiment of the point-of-sale (POS) system formed in accordance with the present invention. The POS system preferably includes a computer 12, receipt printer 16, and cash drawer 24. The system is similar to the conventional system shown in FIG. 1, except that an AC-coupled interface circuit is electrically connected in a series between a driving transistor 18 in the receipt printer 16 and a solenoid 22 in the cash drawer 24.

The interface circuit preferably includes a resistor R, a first capacitor C1, and a second capacitor C2. It is to be understood that the resistor R could be replaced with a resistive network of two or more resistors and/or additional passive and/or active components in series and/or parallel while remaining within the scope of the present invention. Similarly, it is to be understood that the capacitors C1, C2 could be replaced with a capacitive network of one or more capacitors and/or additional passive and/or active components in series and/or parallel while remaining within the scope of the present invention.

The first capacitor C1 and the second capacitor C2 are preferably electrically coupled in series. The series combination of capacitors C1, C2 are preferably electrically coupled in parallel with the resistor R. The parallel combination of the resistor R and series combination of capacitors C1, C2 are preferably electrically coupled in a series between the driving transistor 18 and the solenoid 22. The remaining terminal of the solenoid 22 is preferably connected to ground and the emitter of the driving transistor 18 is connected to Vcc.

The computer 12 preferably provides a digital control signal 26 to the receipt printer 16. This signal is then preferably conditioned and/or translated to a signal that is appropriate for driving the base of the transistor 18 to bias the transistor 18 in an on state. When the transistor 18 is biased on, Vcc, which is preferably connected to the emitter, is substantially applied as an energizing signal 28 to the cash drawer 24.

To deliver a sufficient amount of current to the solenoid 22 to open the cash drawer 24, the AC-coupled capacitance provided by the first capacitor C1 and the second capacitor C2 should preferably be larger than about 470 uf 25 VDC. Such capacitance values are generally only available in a polarized electrolytic capacitor.

Figure 5:
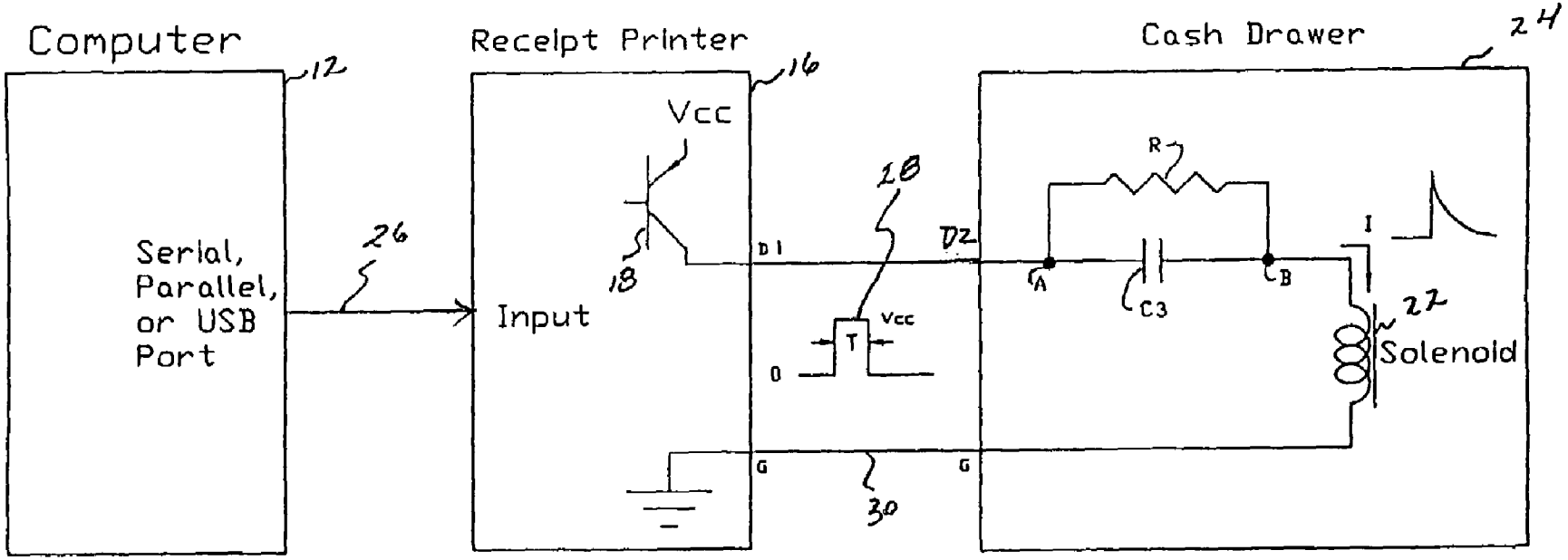
FIG. 5 is a block diagram of a fourth embodiment of a point-of-sale (POS) system formed in accordance with the present invention.

However, a non-polarized equivalent capacitance is preferable, since the interface connections (energizing signal 28 and grounding connection 30) between the receipt printer 16 and the cash drawer 24 may be reversed, particularly during installation. Accordingly, by connecting two polarized capacitors C1, C2 in a back-to-back configuration, that is, connecting common polarities of the capacitors to each other, the resulting equivalent capacitance is non-polarized. C1 and C2 may be replaced by a single non-polarized electrolytic capacitor C3, as shown in FIG. 5. However, such a capacitor is more expensive than two polarized capacitors.

Figure 6:
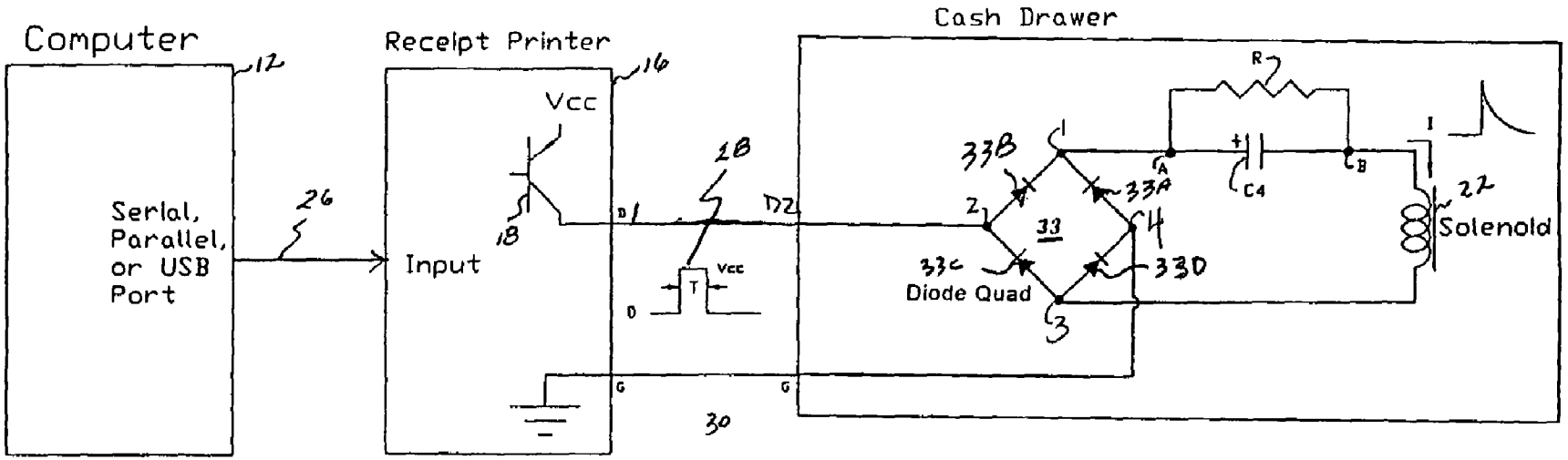
FIG. 6 is block diagram of a fifth embodiment of a point-of-sale (POS) system formed in accordance with the present invention.

Alternatively, a diode quad or bridge 33, as shown in FIG. 6, may be coupled between the receipt printer and cash drawer to toggle a specified voltage polarity to a polarized capacitor C4. That is, if the diode quad 33 is coupled as shown in FIG. 6, that is, with Node 1 coupled to Node A, then the driving voltage at Node A will be positive. Alternatively, if the diode quad 33 is rotated 180° such that Node 3 of the diode quad 33 is coupled to Node A and Node 1 is coupled to the solenoid 22, then the voltage at Node A will be negative. In this case, the polarity of the electrolytic capacitor C4 is preferably reversed such that the negative terminal of the capacitor C4 is coupled to Node A and Node 1. Incorporation of the diode quad 33 adds to the cost and attenuates the driving signal to the solenoid. Schottky diodes may be used to reduce attenuation, but will also add to the cost.

Preferably, the diode quad 33 includes a first diode 33A, second diode 33B, third diode 33C, and a fourth diode 33D. A cathode of the first diode 33A is preferably connected to a cathode of the second diode 33B at Node 1, and an anode of the second diode 33B is preferably connected to a cathode of the third diode 33 at Node 2. An anode of the third diode 33C is preferably connected to an anode of the fourth diode 33D at Node 3, and a cathode of the fourth diode 33D is preferably connected to an anode of the first diode 33A at Node 4. The energizing signal is preferably coupled to Node 2, and the parallel combination of the resistance and the capacitance is preferably coupled to Node 1. Node 4 is preferably coupled to ground, and Node 3 is preferably coupled to the solenoid 22.

The operation of the interface circuit, as shown in FIG. 2, is best explained by considering an example. Assuming the value of the first capacitor C1 is equal to that of the second capacitor C2, which are both equal to a capacitance C, the equivalent capacitance of C1 and C2 is equal to C, not C/2. For instance, if the polarity of the capacitors C1, C2 are connected as shown in FIG. 2 (the anodes of capacitors C1, C2 are coupled together) and node A is at a positive voltage, such as Vcc, the first capacitor C1 is reversed biased and thus shorted. In this case, the capacitance at node A is equal to the forward biased second capacitor C2 or C.

Likewise, if node A is at a negative voltage, the first capacitor C1 is forward biased and the second capacitor C2 is reverse biased and thus shorted. In this case, the capacitance at node A is equal to the forward biased first capacitor C1 or again C.

To open the cash drawer 24, the computer 12 preferably provides the digital control signal 26 to the receipt printer 16, which translates the digital signal to an appropriate pulse or energizing signal 28 for application to the AC-coupled interface circuit in the cash drawer 24. The current generated in the interface circuit results in an exponentially decaying signal that passes through the solenoid 22.

Assuming that the solenoid 22 has an inductance L with an equivalent series resistance R, the time constant of the RLC circuit is preferably chosen to be about two to five times the 100–500 millisecond driving pulse to assure that the total energy delivered to the solenoid 22 is about the same as that provided by the DC-coupled interface shown in the conventional POS system of FIG. 1.

When the pulse in the energizing signal 28 returns to the ground state, the first capacitor C1 and the second capacitor C2 preferably discharge through the resistor R and return all voltage levels back to their steady-state values. If the duration of the pulse is excessively long, the first capacitor C1 and the second capacitor C2 block the DC current that may flow under such circumstances into the solenoid 22, thus preventing the solenoid 22 from being damaged.

The value of the resistor R is preferably about 680 ohms at 1 watt. A lower value for the resistor R would enable the first capacitor C1 and the second capacitor C2 to discharge more quickly, which may be advisable under certain applications, such as when the cash drawer 24 must be repeatedly and rapidly opened. However, the value of the resistor R should be chosen high enough such that if a steady-state voltage level substantially equal to Vcc is applied to the AC coupled interface circuit, the resistor R will still be able to dissipate safely a sufficient amount of power.

Figure 3:
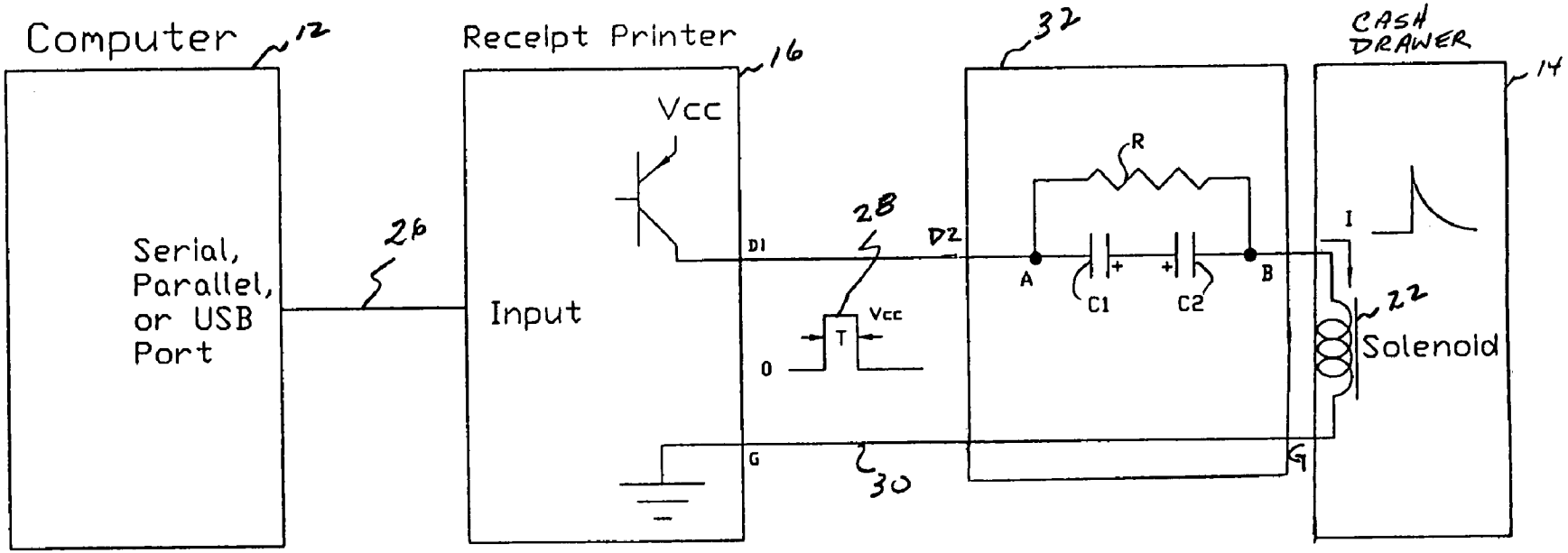
FIG. 3 is a block diagram of a second embodiment of a point-of-sale (POS) system formed in accordance with the present invention.

FIG. 3 shows a second embodiment of the POS system formed in accordance with the present invention in which the AC-coupled interface circuit is incorporated in a separate interface enclosure 32, which is preferably located between the receipt printer 16 and the cash drawer 14. This embodiment is particularly suitable for retrofitting existing POS systems, in which the receipt printer 16 or cash drawer 14 cannot readily be modified.

Figure 4:
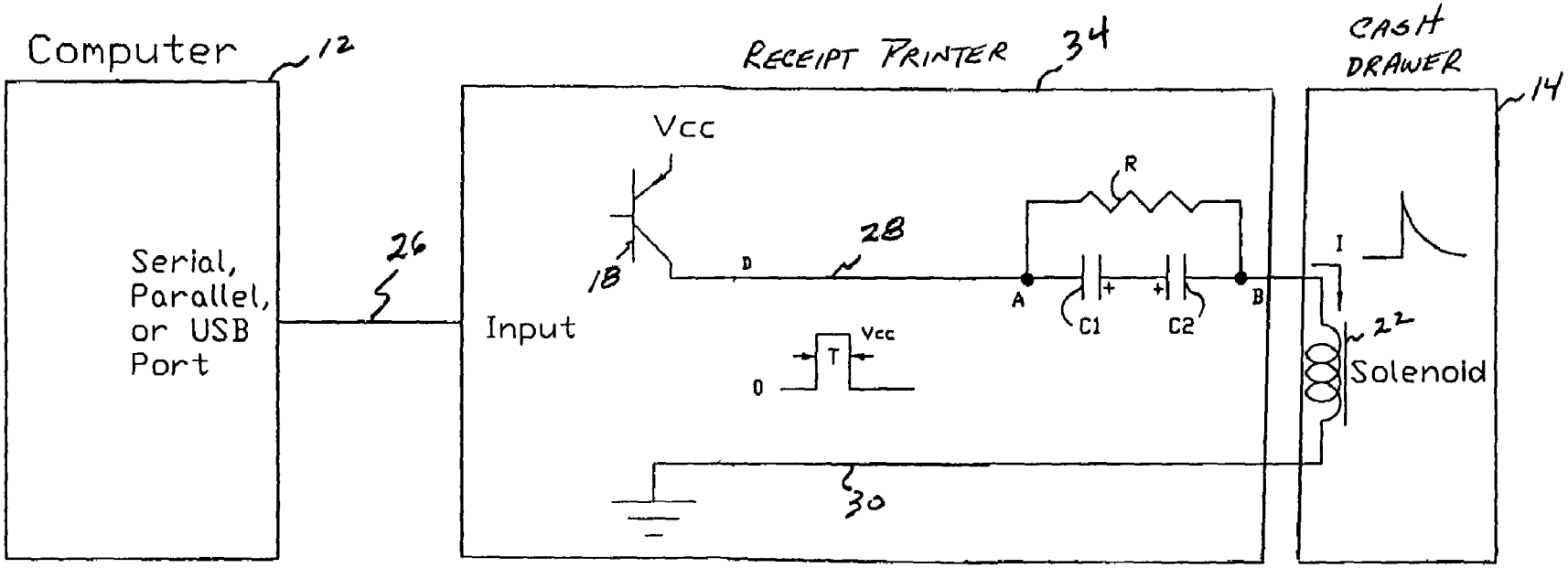
FIG. 4 is a block diagram of a third embodiment of a point-of-sale (POS) system formed in accordance with the present invention.

FIG. 4 shows a third embodiment of the POS system formed in accordance with the present invention, wherein the AC-coupled interface circuit has been incorporated into a modified receipt printer 34. Although placement of the AC-coupled interface circuit has been shown and described with respect to three embodiments, these examples are not intended to limit the scope of the invention to the specified embodiments.

Although illustrative embodiments of the present invention have been described herein with reference to the accompanying drawing, it is to be understood that the invention is not limited to those precise embodiments, and that various other changes and modifications may be affected therein by one skilled in the art without departing from the scope or spirit of the invention.

The invention claimed is:

1. An apparatus for protecting at least one of a solenoid and receipt printer in a point-of-sale system, the apparatus comprising:

a resistance;

a capacitance, the capacitance being electrically coupled in parallel with the resistance to form a parallel network, the parallel network being electrically coupled in series with the solenoid, an energizing signal operatively coupled to the parallel network to energize the solenoid, the parallel network comprising an equivalent resistance and an equivalent capacitance adapted to prevent the solenoid from being damaged by the energizing signal, thereby protecting the solenoid from being damaged by the energizing signal.

2. An apparatus for protecting at least one of a solenoid and receipt printer in a point-of-sale system, as defined in claim 1, wherein the capacitance comprises a first capacitor and a second capacitor, the first capacitor and the second capacitor being electrically coupled in series with each other, the series combination of the first capacitor and the second capacitor being electrically coupled in parallel with the resistance.

3. An apparatus for protecting at least one of a solenoid and receipt printer in a point-of-sale system, as defined in claim 2, wherein the first capacitor and the second capacitor are polarized capacitors, the first capacitor and the second capacitor being electrically coupled back-to-back in series with each other and having common polarities connected to each other.

4. An apparatus for protecting at least one of a solenoid and receipt printer in a point-of-sale system, as defined in claim 1, wherein the capacitance is electrolytic.

5. An apparatus for protecting at least one of solenoid and receipt printer in a point-of-sale system, as defined in claim 1, wherein the point-of-sale system comprises a computer, receipt printer, and cash drawer.

6. An apparatus for protecting at least one of a solenoid and receipt printer in a point-of-sale system, as defined in claim 1, wherein the apparatus is adapted for placement in a receipt printer of the point-of-sale system.

7. An apparatus for protecting at least one of a solenoid and receipt printer in a point-of-sale system, as defined in claim 1, wherein the apparatus is adapted for placement in a cash drawer of the point-of-sale system.

8. An apparatus for protecting at least one of a solenoid and receipt printer in a point-of-sale system, as defined in claim 1, wherein the apparatus is adapted for placement in a separate enclosure.

9. An apparatus for protecting at least one of a solenoid and receipt printer in a point-of-sale system, as defined in claim 1, wherein the resistance has an equivalent resistance of about 680 ohms.

10. An apparatus for protecting at least one of a solenoid and receipt printer in a point-of-sale system, as defined in claim 1, wherein the capacitance has an equivalent capacitance of at least about 470 uf.

11. An apparatus for protecting at least one of a solenoid and receipt printer in a point-of-sale system, as defined in claim 1, wherein the resistance comprises a resistive network, the resistive network comprising at least two resistors.

12. An apparatus for protecting at least one of a solenoid and receipt printer in a point-of-sale system, as defined in claim 1, wherein the capacitance comprises a capacitive network, the capacitive network comprising at least two capacitors.

13. An apparatus for protecting at least one of a solenoid and receipt printer in a point-of-sale system, as defined in claim 1, wherein the capacitance comprises a non-polarized capacitor.

14. An apparatus for protecting at least one of a solenoid and receipt printer in a point-of-sale system, as defined in claim 1, further comprising a diode quad operatively coupled between the energizing signal and the parallel network.

15. An apparatus for protecting at least one of a solenoid and receipt printer in a point-of-sale system, as defined in claim 14, wherein the diode quad includes a first diode, a second diode, a third diode, and a fourth diode.

16. An apparatus for protecting at least one of a solenoid and receipt printer in a point-of-sale system, as defined in claim 15, wherein a cathode of the first diode is operatively coupled to a cathode of the second diode at a first node, an anode of the second diode is operatively coupled to a cathode of the third diode at a second node, an anode of the third diode is operatively coupled to an anode of the fourth diode at a third node, a cathode of the fourth diode is operatively coupled to an anode of the first diode at a fourth node, the energizing signal being operatively coupled to the second node, the parallel network of the resistance and the capacitance being operatively coupled to the first node, the fourth node being operatively coupled to ground, the third node being operatively coupled to the solenoid.

17. A method of protecting at least one of a solenoid and receipt printer in a point-of-sale system, the method comprising the steps of:

coupling a resistance electrically in parallel with a capacitance to form a parallel network;

coupling the parallel network electrically in series with the solenoid; and coupling an energizing signal operatively to the parallel network to energize the solenoid, the parallel network comprising an equivalent resistance and an equivalent capacitance adapted to prevent the solenoid from being damaged by the energizing signal. thereby protecting the solenoid from being damaged by the energizing signal.

18. A method of protecting at least one of a solenoid and receipt printer in a point-of-sale system, as defined in claim 17, wherein the step of coupling the resistance electrically in parallel with the capacitance comprises the steps of:

coupling a first capacitor and a second capacitor electrically in series with each other; and coupling the series network of the first capacitor and the second capacitor electrically in parallel with the resistance.

19. A method of protecting at least one of a solenoid and receipt printer in a point-of-sale system, as defined in claim 18, wherein the first capacitor and the second capacitor are polarized capacitors and the step of coupling the first capacitor and the second capacitor electrically in series with each other further comprises the step of coupling the first capacitor and the second capacitor electrically back-to-back in series with each other and having common polarities connected to each other.

20. A method of protecting at least one of a solenoid and receipt printer in a point-of-sale system, as defined in claim 17, wherein the point-of-sale system comprises a computer, receipt printer, and cash drawer.

21. A method of protecting at least one of a solenoid and receipt printer in a point-of-sale system, as defined in claim 17, comprising the step of adapting the apparatus for placement in a receipt printer of the point-of-sale system.

22. A method of protecting at least one of a solenoid and receipt printer in a point-of-sale system, as defined in claim 17, comprising the step of adapting the apparatus for placement in a cash drawer of the point-of-sale system.

23. A method of protecting at least one of a solenoid and receipt printer in a point-of-sale system, as defined in claim 17, comprising the step of adapting the apparatus for placement in a separate enclosure.

24. A method of protecting at least one of a solenoid and receipt printer in a point-of-sale system, as defined in claim 17, wherein the step of coupling the resistance electrically in parallel with the capacitance to form a parallel network further comprises the step of coupling a resistive network electrically in parallel with the capacitance, the resistive network comprising at least two resistors.

25. A method of protecting at least one of a solenoid and receipt printer in a point-of-sale system, as defined in claim 17, wherein the step of coupling the resistance electrically in parallel with the capacitance to form a parallel network further comprises the step of coupling a capacitive network electrically in parallel with the resistance, the capacitive network comprising at least two capacitors.

26. A method of protecting at least one of a solenoid and receipt printer in a point-of-sale system, as defined in claim 17, wherein the step of coupling the resistance electrically in parallel with the capacitance to form a parallel network further comprises the step of coupling a non-polarized capacitor in parallel with the resistance.

27. A method of protecting at least one of a solenoid and receipt printer in a point-of-sale system, as defined in claim 17, further comprising the step of coupling a diode quad operatively between the energizing signal and the parallel network.

28. An apparatus for protecting at least one of a solenoid and receipt printer in a point-of-sale system, as defined in claim 17, wherein the step of coupling the diode quad includes the step of coupling a first diode, a second diode, a third diode, and a fourth diode.

29. An apparatus for protecting at least one of a solenoid and receipt printer in a point-of-sale system, as defined in claim 28, wherein the step of coupling the first, second, third, and fourth diodes further includes the steps of:

coupling a cathode of the first diode operatively to a cathode of the second diode at a first node;

coupling an anode of the second diode operatively to a cathode of the third diode at a second node;

coupling an anode of the third diode operatively to an anode of the fourth diode at a third node;

coupling a cathode of the fourth diode operatively to an anode of the first diode at a fourth node;

coupling the energizing signal operatively to the second node;

coupling the parallel network of the resistance and the capacitance operatively to the first node;

coupling the fourth node operatively to ground; and coupling the third node operatively to the solenoid.

* * * * *